US007066633B2

(12) United States Patent
Ng et al.

(10) Patent No.: US 7,066,633 B2
(45) Date of Patent: Jun. 27, 2006

(54) ILLUMINATED DISPLAYS FOR ALPHANUMERIC AND SPECIAL CHARACTERS

(76) Inventors: Kee Yean Ng, 6, Halaman Kikik, Taman Interawasih, 13600, Prai, Penang (MY); Heng Yow Cheng, 18, Lebuh Batu Maung 12, 11960 Penang (MY); Chee Wai Chia, 11-19-03, K-Series, Jalan Gangsa, 11600 Penang (MY)

( * ) Notice: Subject to any disclaimer, the term of this patent is extended or adjusted under 35 U.S.C. 154(b) by 90 days.

(21) Appl. No.: 10/820,342

(22) Filed: Apr. 7, 2004

(65) Prior Publication Data

US 2004/0223317 A1 Nov. 11, 2004

Related U.S. Application Data

(60) Provisional application No. 60/462,295, filed on Apr. 11, 2003.

(51) Int. Cl.
*F21V 5/00* (2006.01)

(52) U.S. Cl. ..... 362/559; 362/812; 40/578

(58) Field of Classification Search ..... 362/29–30, 362/23, 812; 40/578, 580; 340/815.54, 340/815.53

See application file for complete search history.

(56) References Cited

U.S. PATENT DOCUMENTS 6,422,711 B1 7/2002 Chao et al.
6,658,774 B1 * 12/2003 Munter et al. ..... 40/574
6,722,066 B1 * 4/2004 Cheung ..... 40/581

* cited by examiner

*Primary Examiner*—Ali Alavi

(57) ABSTRACT

An illuminated display is disclosed which allows characters to be displayed with near type-set like appearance. This is accomplished by using an appropriately formed and placed rib to connect the optically opaque inner member with the optically opaque base.

17 Claims, 6 Drawing Sheets

ILLUMINATED DISPLAYS FOR ALPHANUMERIC AND SPECIAL CHARACTERS

CROSS REFERENCE TO RELATED APPLICATIONS

This application claims priority to Provisional Application No. 60/462295 filed on Apr. 11, 2003.

BACKGROUND OF INVENTION

Illuminated displays for alphanumeric and special characters are typically used in electronic devices and appliances. Examples include digital displays for time and other information typically present on microwave ovens and video cassette recorders. These displays typically have an opaque base with an opening that defines an outline of a letter, a number or a special character such as a symbol or punctuation mark. Light from an electrically-operated light source such as a light emitting diode (LED) is typically projected through the opening.

If the character being outlined is an open character such as the numeral "2" or the letter "L", the illuminated display for that character closely represents a typeset version of that character and is aesthetically pleasing to the human eye. However, if the character being outlined is a closed character such as the letter "D" or the numeral "8", the characters typically have a stenciled appearance that is not aesthetically pleasing to the human eye. A closed character encloses an inner member that must have a means for anchoring to the opaque base.

Some displays, for example, such as the widely used seven segment numeric display can be switched to represent any of several different characters. The seven segment display typically uses seven different straight line segments to form the numerals zero through nine. Each straight line segment is typically illuminated by a different light source so that different segments may be illuminated as desired to form different numerals. These numerals have an appearance similar to stenciled numerals. For displays that need to be switchable from one character to another, such as a digital time display, this is typically adequate.

Other displays only show a single character or a sequence of characters having a defined meaning such as a word, for example. An example of such an illuminated display is an electronic display for kitchen appliances that at different times illuminates one or more words such as "BAKE", "BROIL", "WARM", or "HOLD". It is typically desirable for such characters or sequence of characters to have a typeset character appearance without visible supporting members connecting the base to the inner members of the display for closed characters. For example, in the display for the word "BAKE" the letter "B" is a closed character with two enclosed inner members and the letter "A" is a closed character with one enclosed inner member whereas the letters "K" and "E" are open characters. If the supporting members that support the enclosed inner members of the display for the letters "B" and "A" are not visible then all four characters in the word "BAKE" appear to be typeset when the word "BAKE" is illuminated.

An approach to the problem of providing illuminated characters a typeset appearance is disclosed in U.S. Pat. No. 6,422,711 issued Jul. 23, 2002 to Chao et al. The Chao et al patent discloses an embodiment having a rib that functions to connect an inner member of a closed character to the opaque base of the display. The rib disclosed in the Chao et al patent protrudes from one surface of the base and therefore limits the usefulness of the approach.

Hence, an illuminated display where closed characters have a typeset character appearance without any visible members connecting the inner members of closed characters to the base of the display is desirable.

SUMMARY OF THE INVENTION

In accordance with the invention, characters or icons on an illuminated display may be created having a closed character or icon with an inner member that has no supporting member readily visible to the human eye and no support member protruding beyond a surface of the base of the display.

DETAILED DESCRIPTION OF THE INVENTION

Figure 1:
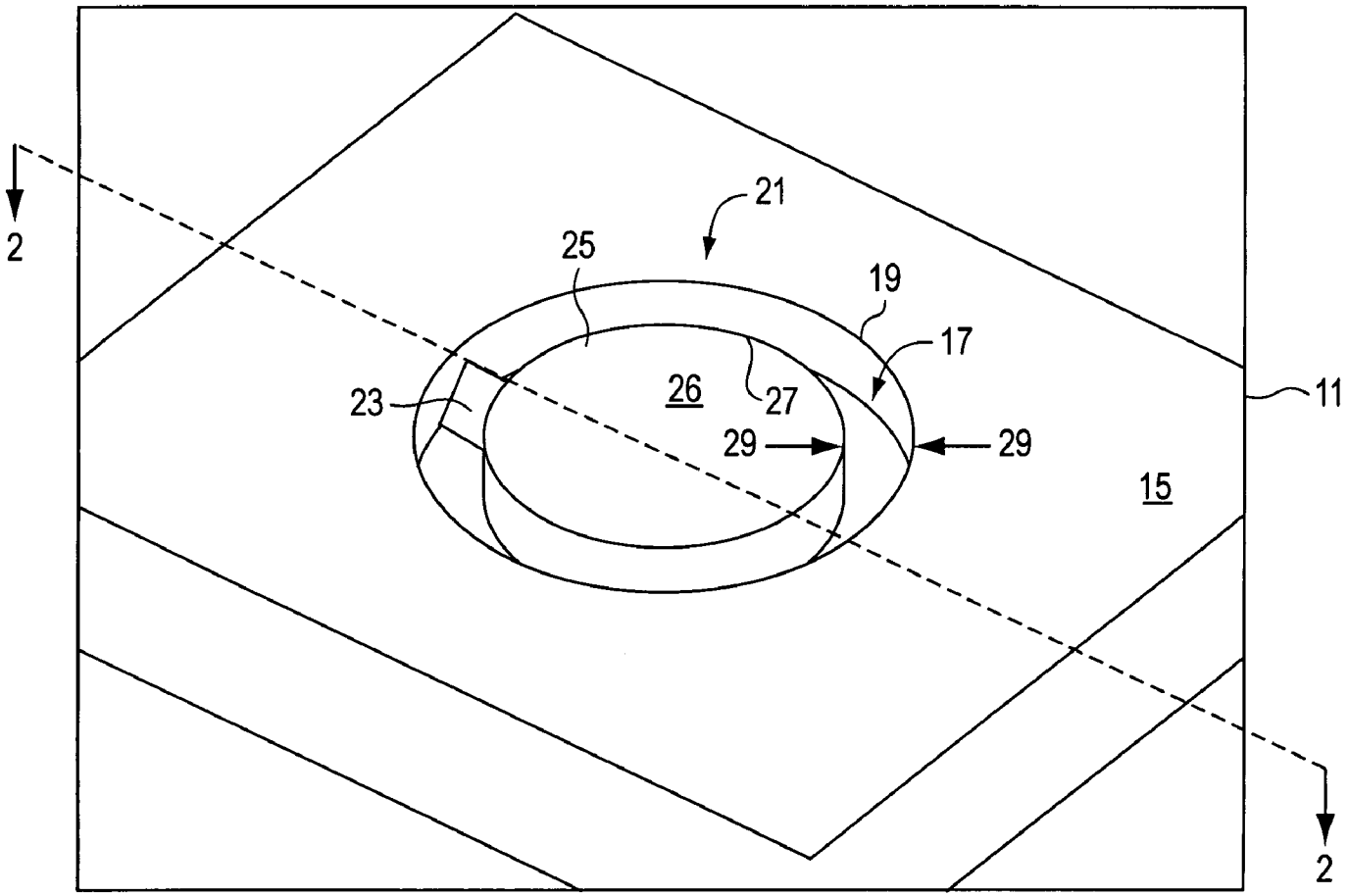
FIG. 1 is a perspective view of an illuminated display of a substantially round character in accordance with the invention.

Embodiments in accordance with the invention provide for illuminated displays having closed characters where the supporting rib for the inner member is not visible and no support structure extends beyond the surface of the base of the display. Several embodiments in accordance with the invention are depicted and for convenience, elements that are similar from one embodiment to another embodiment carry the same reference numerals and those elements that differ from one embodiment to another are denoted with the same reference numerals with added alphabetic characters to distinguish them.

Figure 2:
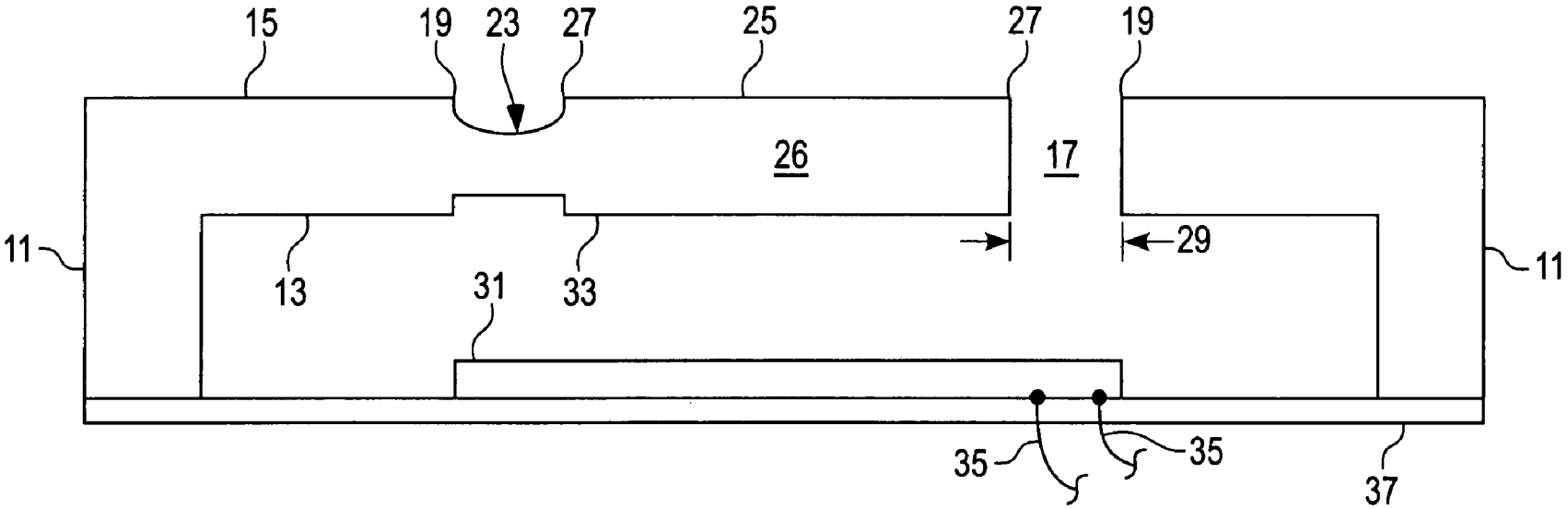
FIG. 2 is a section view taken along the line 2—2 of FIG. 1.
Figure 3:
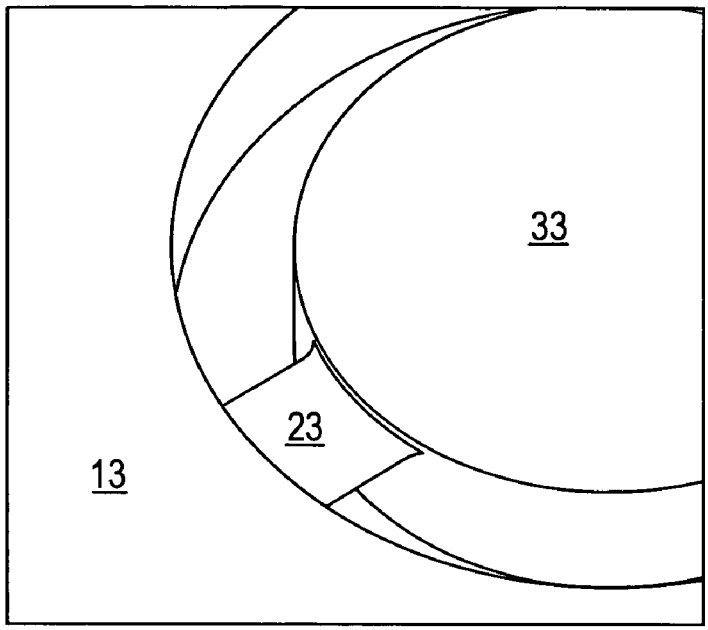
FIG. 3 is a perspective view of a portion of one surface of the display shown in FIGS. 1 and 2 with the light source and light source support omitted.

FIGS. 1–3 show an illuminated display in accordance with the invention that has optically opaque base 11 with first surface 13, second surface 15 and optically transmissive opening 17, opening 17 defining outer perimeter 19 of display element 21. Rib 23 is attached to base 11 and positioned within opening 17. Optically opaque inner member 26 defines inner perimeter 27 of display element 21 and is positioned within opening 17 to define region 29 between inner perimeter 27 and outer perimeter 19. Inner member 26 is attached to rib 23. Light source 31, for example, a light emitting diode (LED), projects light toward first surface 13 of base 11 and toward first surface 33 of inner member 26 so that light is transmitted through region 29. Electrical conductors 35, typically copper or aluminum, provide electrical power to light source 31. Light source 31 is held in position by support 37 (see FIG. 2). Base 11 and inner member 26 are typically made from opaque plastic material.

In an embodiment in accordance with the invention, rib 23 is recessed into opening 17 with respect to first surface 13 and second surface 15 of base 11. Inner member 26 is typically about 0.8 mm thick. Base 11 adjacent to opening 17 is also typically about 0.8 mm thick. Rib 23 is typically recessed about 0.05 mm to about 0.1 mm from first surface 13 and should not be recessed so far as to weaken the display to the extent that it is not reproducible using a standard molder. Rib 23 typically needs to be recessed from second surface 15 sufficiently far to allow the encapsulating material such as epoxy to flow over rib 23 and hide it from view while still allowing sufficient illumination. Adjacent to second surface 15, rib 23 is typically sculpted and recessed between about 0.3 mm and about 0.4 mm from second surface 15. Sculpting rib 23 typically involves forming rib 23 so that it is less perceptible to the human eye. Ideally, when the surface of rib 23 is recessed from second surface 15, rib 23 presents a line to the human eye. Typical requirements for sculpted rib 23 are that sculpted rib 23 be thinner or smaller in the direction of second surface 15 that is typically visible to the human eye and thicker or bigger in the direction of first surface 13 which is typically hidden from the human eye. The tapering of rib 23 ensures structural strength. The recited dimensions are not critical to the invention and may be varied as appropriate according to the requirements for display element embodiments such as the size and the number of display elements desired.

Figure 4:
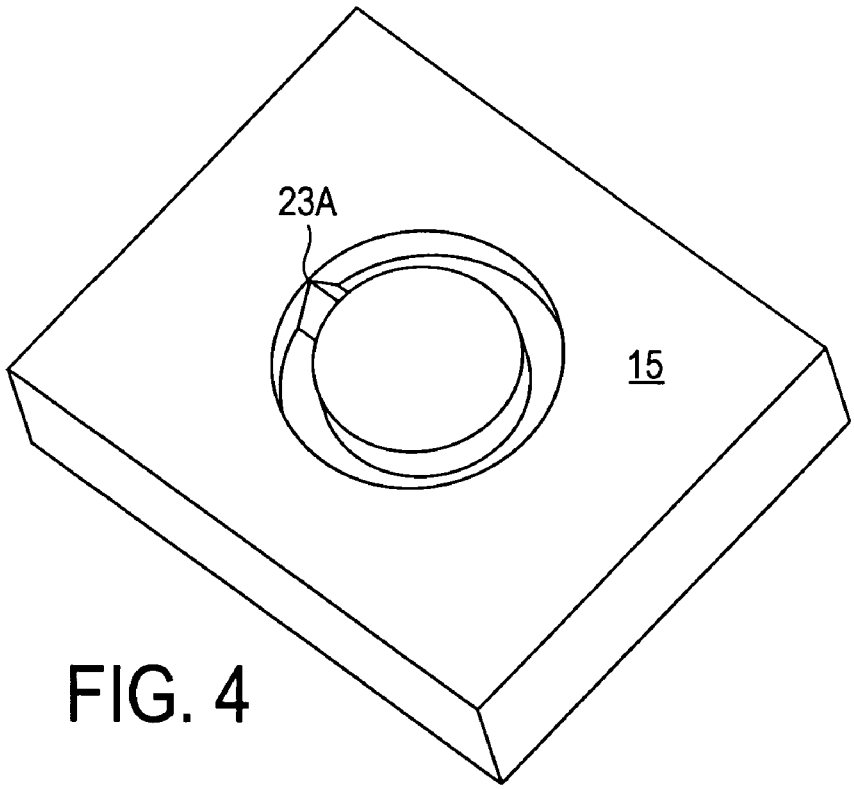
FIG. 4 shows an embodiment in accordance with the invention with the rib not sculpted.

In an embodiment in accordance with the invention shown in FIG. 4, rib 23A is not sculpted adjacent to second surface 15 of base 11.

Figure 5:
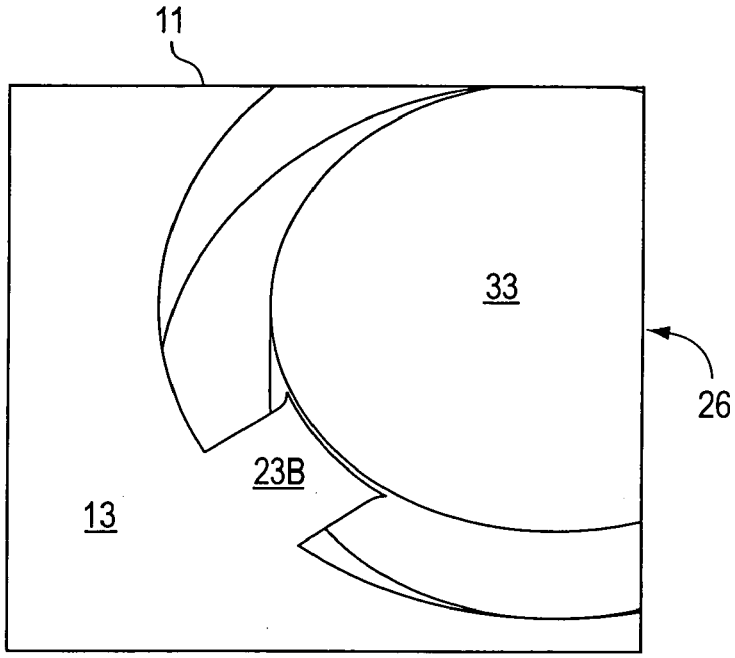
FIG. 5 shows an embodiment in accordance with the invention with the rib recessed from the inner member.

In an embodiment in accordance with the invention shown in FIG. 5, rib 23B is coplanar with first surface 13 of base 11 and is slightly recessed and not coplanar with respect to first surface 33 of inner member 26.

Figure 6:
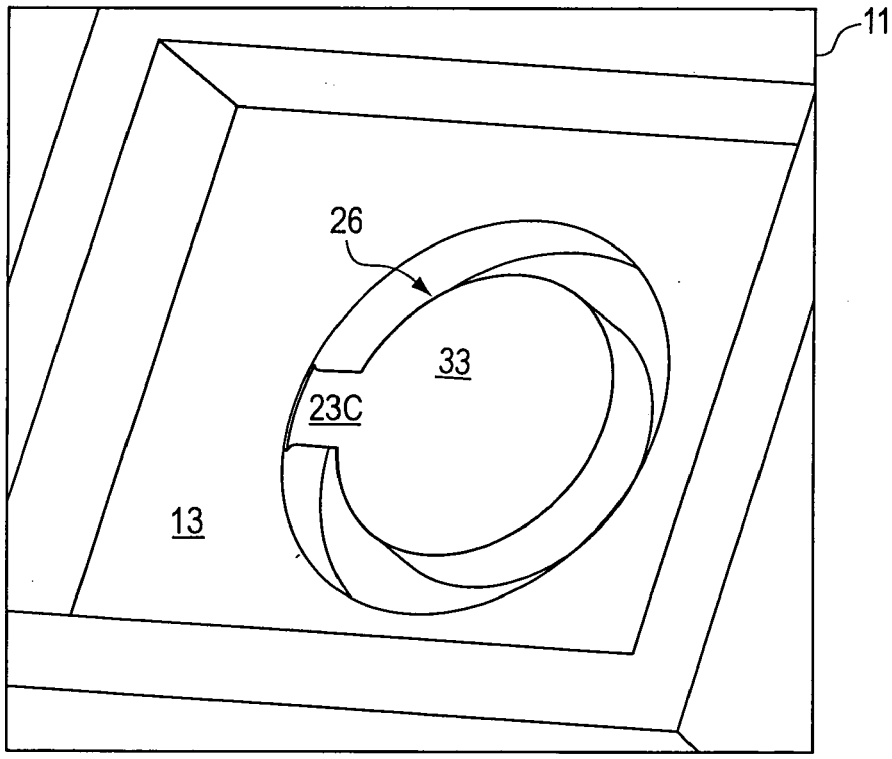
FIG. 6 shows an embodiment in accordance with the invention with the rib recessed from the base.

In an embodiment in accordance with the invention shown in FIG. 6, rib 23C is substantially coplanar with first surface 33 of inner member 26 but is slightly recessed and not coplanar with respect to first surface 13 of base 11.

In an embodiment in accordance with the invention, light source 31 includes at least one LED. Depending on the desired configuration, a plurality of light sources 31 such as LEDs may be used. Other choices for illumination include incandescent lamps, fluorescent lamps, lasers and the like.

Figure 7:
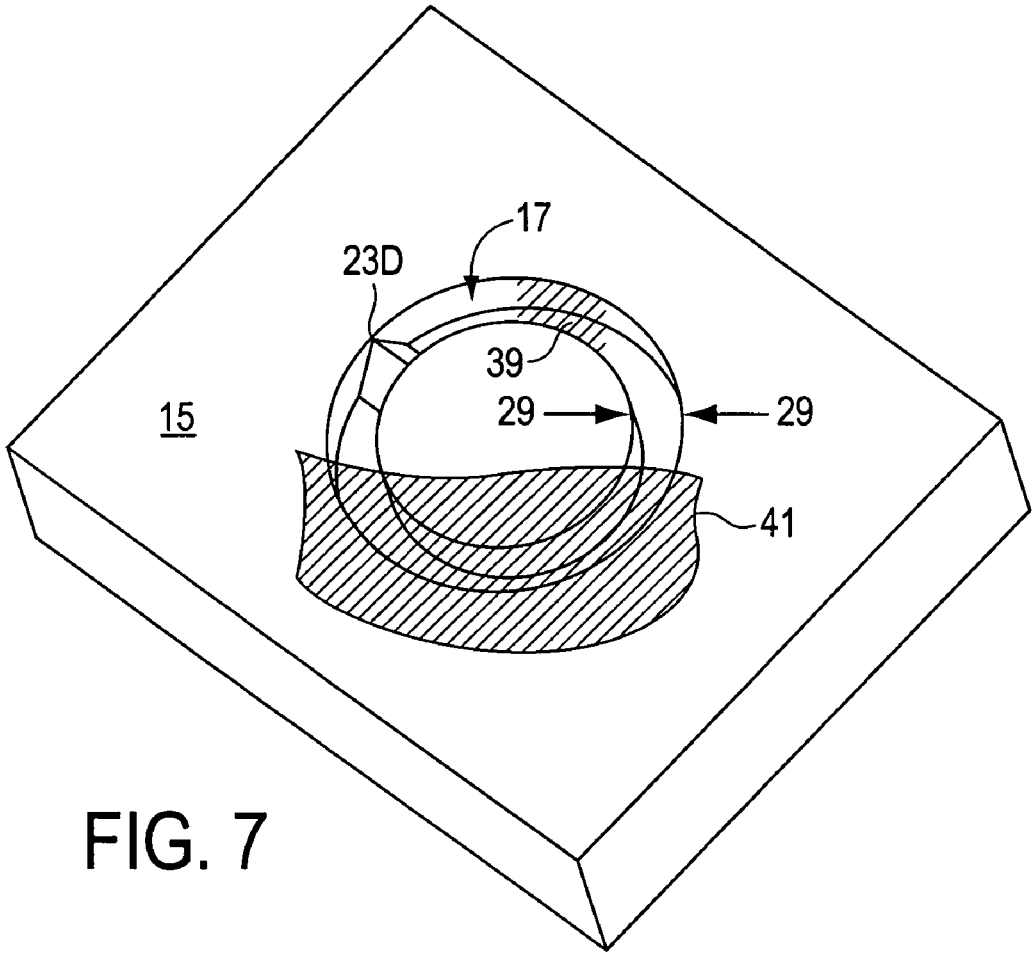
FIG. 7 shows an embodiment in accordance with the invention with a portion of the region filled with light diffusing material.

In accordance with the invention, diffusing material 39 such as, for example, a translucent filter, may be positioned in region 29 as shown in FIG. 7. While only a portion of region 29 is shown as being filled, all of region 29 may be filled with diffusing material 39 to diffuse the light and provide a more uniform appearance to the displayed alphanumeric element or icon. Alternatively, diffusing film 41 may be applied to surface 15 of base 11 and second surface 25 of inner member 26 to cover opening 17. While only a portion of opening 17 as shown in FIG. 7 is covered by diffusing film 41, it is clear that all of opening 17 may be covered with diffusing film 41. If desired, both diffusing film 41 and diffusing material 39 may be used. With respect to FIG. 7, rib 23D is shown as sculpted such that rib 23D is coplanar with second surface 15 of base 11 at the point where rib 23D and base 11 meet and elsewhere rib 23D is recessed into opening 17 in relation to second surface 15 of base 11.

Figure 9:
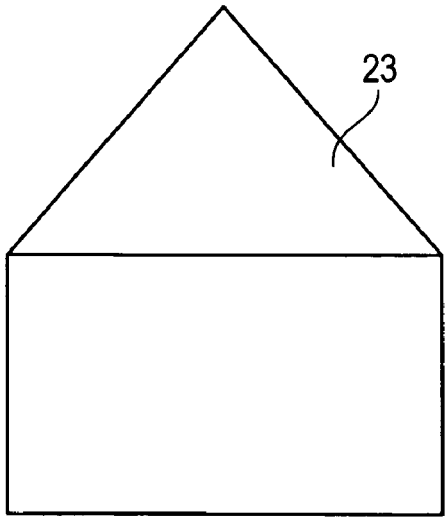
FIG. 9 shows an alternative rib cross-section in accordance with the invention.

Rib 23 has been depicted as being triangular in cross-section and oriented such that the apex of the substantially triangular cross-section of rib 23 is located adjacent to second surface 15 of base 11. The shape of rib 23 is not typically critical and other shapes may be used as desired. For example, rib 23 may have a substantially triangular cross-section with curved sides that are either convex or concave. Also, rib 23 may have a polygonal shape having a cross-section resembling a triangle positioned over the side of a rectangle as shown in FIG. 9.

Figure 8:
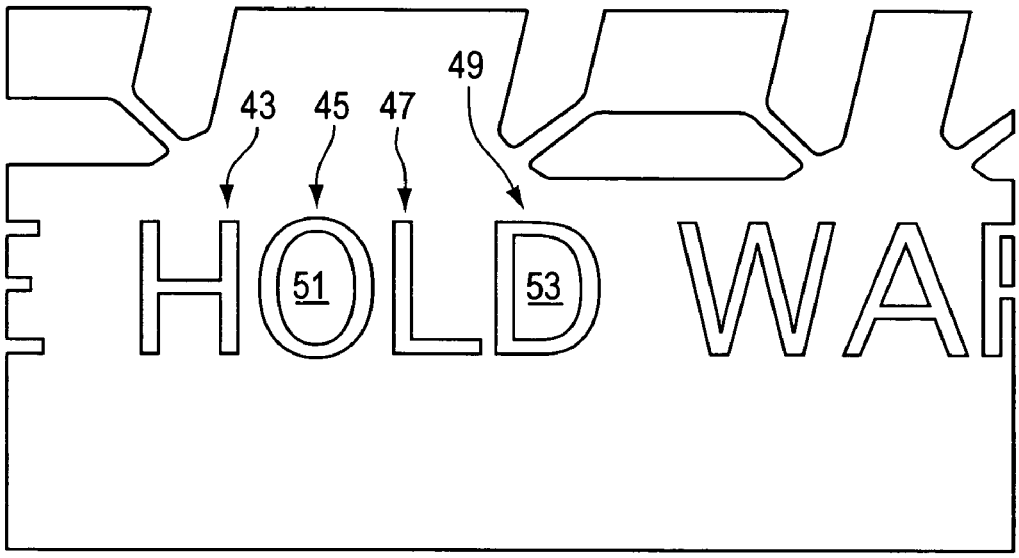
FIG. 8 shows a front view of an embodiment in accordance with the invention having a number of openings for defining alphanumeric characters.

In some embodiments in accordance with the invention, base 11 has a plurality of optically transmissive openings, each opening defining a display element such as an alphanumeric character or icon. The display elements are typically arranged in a sequence having a predefined meaning. For example, in FIG. 8 base 11 has openings 43, 45, 47 and 49 that define alphanumeric characters "H", "O", "L" and "D", respectively. At least one of openings 43, 45, 47 and 49 defines a closed alphanumeric character that encloses an inner member. In particular with respect to FIG. 8, openings 45 and 49 define closed characters "O" and "D", respectively, opening 45 enclosing an inner member 51 and opening 49 enclosing inner member 53. The four alphanumeric characters defined by openings 43, 45, 47 and 49 together spell the word "HOLD". One or more light sources as desired may be activated so as to light up all four characters when the word "HOLD" is displayed.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

The invention claimed is:

1. A display comprising:

an optically opaque base comprising first and second surfaces, said optically opaque base comprising an aperture, said aperture defining an outer perimeter of a display element;

a rib attached to said base and disposed within said aperture such that said rib is recessed with respect to said first and second surfaces of said base;

an optically opaque inner member defining an inner perimeter of said display element, said inner member disposed in said aperture to define a region between said outer and inner perimeters of said display element, said inner member attached to said rib; and a light source disposed to project light toward said inner member and said base such that light passes through said region.

2. A display element as in claim 1 wherein said light source comprises at least an LED.

3. A display as in claim 1 further comprising a diffusing material disposed in at least a portion of said region.

4. A display as in claim 1 further comprising a diffusing film disposed on one of said first and said second surfaces so as to cover said region.

5. A display as in claim 1 wherein said rib has an approximately triangular cross-section, said rib having an apex of said triangular cross-section located proximate to one of said first and said second surfaces.

6. A display as in claim 1 wherein said display element comprises an alphanumeric character.

7. A display as in claim 1 wherein said rib is recessed about 0.05 mm from one of said first and second surfaces.

8. A display as in claim 1 wherein said rib is tapered.

9. A display comprising:

an optically opaque base comprising first and second surfaces, said optically opaque base comprising an aperture therethrough, said aperture defining an outer perimeter of a display element;

a sculpted rib attached to said base and disposed within said aperture such that said sculpted rib is recessed with respect to said first surface and said second surface of said base;

an optically opaque inner member defining an inner perimeter of said display element, said inner member disposed in said aperture to define a region between said outer and inner perimeters of said display element, said inner member attached to said sculpted rib; and a light source disposed to project light toward said inner member and said base such that light passes through said region.

10. A display as in claim 9 wherein said sculpted rib has a substantially triangular cross-section.

11. A display as in claim 10 wherein said triangular cross-section comprises curved sides.

12. A display as in claim 9 wherein said sculpted rib has a cross-section resembling a triangular shape on top of a rectangle.

13. A display comprising:

an optically opaque base comprising first and second surfaces, said optically opaque base comprising a plurality of apertures therethrough, each said aperture defining an alphanumeric character, said alphanumeric characters being arranged in a sequence having a defined meaning, at least one of said apertures defining a closed alphanumeric character that encloses an optically opaque inner member comprising a third surface substantially coplanar with said first surface of said base and a fourth surface substantially coplanar with said second surface of said base;

a sculpted rib disposed within said aperture defining said closed alphanumeric character such that said sculpted rib is recessed with respect to said first surface and said second surface of said base, said sculpted rib connecting said inner member to said base such that said inner member is kept in fixed relation to said base; and a light source disposed to project light toward said base such that light passes through said plurality of apertures to illuminate said sequence.

14. A display as in claim 13 further comprising a diffusing film disposed on one of said surfaces of said base and said inner member, said film covering said plurality of apertures.

15. A display as in claim 13 wherein said sculpted rib is tapered.

16. A display element as in claim 13 such that said light source comprises at least an LED.

17. A display as in claim 13 further comprising a diffusing material disposed in said plurality of apertures.

* * * * *